US011052979B2

(12) United States Patent
Spardel et al.

(10) Patent No.: US 11,052,979 B2
(45) Date of Patent: Jul. 6, 2021

(54) ACTIVE STABILIZING DEVICE AND METHOD

(71) Applicant: SKF MARINE GMBH, Hamburg (DE)

(72) Inventors: Holger Spardel, Hamburg (DE); Christian Thieme, Nieklitz (DE)

(73) Assignee: SKF MARINE GMBH, Hamburg (DE)

( * ) Notice: Subject to any disclaimer, the term of this patent is extended or adjusted under 35 U.S.C. 154(b) by 0 days.

(21) Appl. No.: 16/748,972

(22) Filed: Jan. 22, 2020

(65) Prior Publication Data

US 2020/0247509 A1 Aug. 6, 2020

(30) Foreign Application Priority Data

Feb. 6, 2019 (DE) ..... 102019201505.0

(51) Int. Cl.
*B63B 39/06* (2006.01)

(52) U.S. Cl.
CPC ..... *B63B 39/06* (2013.01)

(58) Field of Classification Search
CPC ..... B63B 39/06
See application file for complete search history.

(56) References Cited

U.S. PATENT DOCUMENTS

2018/0057125 A1* 3/2018 Fournier ..... B63B 39/06

FOREIGN PATENT DOCUMENTS

| | | | | |
|---|---|---|---|---|
| EP | 1498348 A1 * | 1/2005 | ..... | B63B 39/06 |
| EP | 1498348 B1 | 9/2007 | | |
| EP | 2910463 A1 * | 8/2015 | ..... | B63B 39/06 |
| EP | 2910463 B1 | 1/2017 | | |
| GB | 2550123 A * | 11/2017 | ..... | B63B 39/06 |
| GB | 2550123 A | 11/2017 | | |
| JP | S6194892 A | 5/1986 | | |
| WO | 2013095097 A1 | 6/2013 | | |
| WO | WO-2013095097 A1 * | 6/2013 | ..... | B63B 39/06 |
| WO | 2017018877 A1 | 2/2017 | | |
| WO | WO-2017018877 A1 * | 2/2017 | ..... | B63B 39/06 |
| WO | 2017074181 A1 | 5/2017 | | |
| WO | WO-2017074181 A1 * | 5/2017 | ..... | B63B 39/06 |

OTHER PUBLICATIONS

European Search Report from the European Patent Office dated Jul. 2, 2020 in related application No. EP 20 15 4090, Including European Search Opinion.

"DYNA-FOIL: The new stabilizer system from Quantum"; Quantum, The Art of Stabilization; Ft. Lauderdale, Florida, USA; wwww.quantumhydraulic.com 2017.

* cited by examiner

*Primary Examiner* — S. Joseph Morano
*Assistant Examiner* — Jovon E Hayes
(74) *Attorney, Agent, or Firm* — J-Tek Law PLLC; Scott T. Wakeman; Mark A. Ussai

(57) ABSTRACT

An active stabilizing device for a primary damping of rolling movements of a ship or other watercraft includes at least one positioning device including a drive journal and a stabilizing fin having a stabilizing surface and a root, the drive journal being attached to the stabilizing fin at the root, the stabilizing surface having a leading edge and a trailing edge and being configured to be disposed underwater. The positioning device is configured to simultaneously pivot the stabilizing fin about a pivot axis by a pivot angle and rotate the stabilizing fin about an axis of rotation. Also, a method of operating the active stabilizing device.

13 Claims, 3 Drawing Sheets

ACTIVE STABILIZING DEVICE AND METHOD

CROSS-REFERENCE

This application claims priority to German patent application no. 10 2019 201 505.0 filed on Feb. 6, 2019, the contents of which are fully incorporated herein by reference.

TECHNOLOGICAL FIELD

The disclosure first relates to an active stabilizing device for primary damping of rolling movements of a watercraft, in particular of a ship, including at least one positioning device including a drive journal and including a stabilizing surface attached in the region of its root to the drive journal, wherein the stabilizing surface includes a leading edge and a trailing edge, and the stabilizing surface is disposed under water.

In addition the disclosure includes as subject matter a method for operating an active stabilizing device, in particular according to one of patent claims 1 to 8, for primary damping of rolling movements of a watercraft, in particular a ship, that is essentially not moving through the water.

In watercraft such as cruise ships, larger motor-driven yachts, or the like, active stabilizing devices for damping in particular rolling movements of the hull are known in a large range of variation.

Thus inter alia stabilizing devices are proposed wherein a damping of undesirable hull movements is effected by heavy rotating masses. In the case of the so-called active fin stabilizers, on the port or starboard side of the hull, respectively, at least one wing-type fin stabilizer is pivoted out far enough until each of the two fin stabilizers has assumed an approximately perpendicular position with respect to the hull. Due to the changing of the angle of attack of the fin stabilizers extending on both sides of the hull and always located under water in the normal case, hydrodynamic uplift- and downthrust-forces of different strengths can optionally be generated when the watercraft moves through the water at a sufficient speed. Using a suitable control and/or regulating device, the uplift and downthrust forces of the fin stabilizers are each set such that they counteract as effectively as possible a rolling movement of the hull, which rolling movement is measured by sensors. Here damping of the rolling movements of the hull of 80% and higher are achievable.

When a watercraft is not actively moving through the water, the variation of the angle of attack of the fin stabilizers by corresponding hydraulic actuators is not sufficient to damp rolling movements, since sufficiently high hydrodynamic forces are not generatable in this way by the fin stabilizers. Rather, in the case of a watercraft not moving through the water or only slowly moving through the water, it is necessary to pivot the fin stabilizers back and forth through the water at constant angle of attack actively and with sufficient speed, for example, using further hydraulic actuators, in order to build up the hydrodynamic forces required for weakening the undesirable rolling movements of the hull of the watercraft. A further possibility consists, for example, in changing the angle of attack of the stabilizing surface rapidly with constant pivot angle in order to build up the forces required for stabilizing the hull by the paddle movement generated in this way.

A slight change of the angle of attack is provided only in the two positions of the pivot movement of the fin stabilizers, from which considerable restrictions arise with respect to the efficiency of the known active stabilizing devices.

SUMMARY

An aspect of the disclosure is to provide an active stabilizing device for damping, in particular, rolling movements of a watercraft, which active stabilizing device makes possible an increased damping effect with reduced stabilizing surfaces. In addition an aspect of the disclosure is to provide a method for operating such a stabilizing device.

This is first achieved by a stabilizing surface that is pivotable using a positioning device about a pivot axis by a pivot angle and simultaneously rotatable about an axis of rotation.

Due to the superposition or the simultaneous carrying out of pivot and rotation movements of the at least one stabilizing device, complex spatial movement patterns of the stabilizing surface occurring under water about a rotational and pivot axis are realizable, from which a more effective damping, in particular, of rolling movements of the watercraft results with a simultaneously significantly reduced stabilizing surface. Furthermore an increased effectiveness of the stabilizing device results at a speed of approximately zero knots or a low speed of the watercraft of up to 4 knots. Due to the reduced size of the stabilizing surface there is a reduced installation space requirement for the stabilizing device in a hull of a watercraft.

Using the drive journal, the positioning device can rotate the stabilizing surface, for example, by up to ±60° or 120° about the axis of rotation, respectively, with respect to the horizontal or the idealized waterline. Starting from a hull longitudinal axis a maximum pivot angle of the drive journal about the pivot axis lies by way of example between 0° and approximately 160°. With the stabilizing device in operation the pivot angle of the stabilizing surface can amount to up to ±60° or 120°, based on a transverse axis of the hull of the watercraft, in order to avoid a hull contact. Optionally it is possible to fix the axis of rotation of the stabilizing surface at an angle $\alpha$ between 5° and 30° at the drive journal. With no heeling of the hull of the ship, a vertical axis (yaw axis) extends essentially parallel to the force of gravity or to the weight force. Here the pivot axis of the stabilizing surface can extend at an angle between 0° up to and including 45° or more with respect to the vertical axis.

The stabilizing surface is preferably rotatable about the axis of rotation by an angle of attack of up to ±60°.

A not-too-high flow resistance thereby arises during pivoting of the stabilizing surface through the water.

In the case of one refinement a radius of curvature of the leading edge of the stabilizing surface is for providing an inflow nose larger than a radius of curvature of the trailing edge.

Consequently a fluidically favorable cross-sectional geometry is provided of the stabilizing surface.

A first cutout is preferably provided leading-edge side in the region of the root of the stabilizing surface, and/or a second cutout is provided trailing-edge-side within the stabilizing surface.

During pivoting of the stabilizing surface a mechanical contact with the hull is thereby avoided and simultaneously the pivot region of the stabilizing surface is enlarged.

In one technically advantageous design a non-co-rotating flow-edge-side inflow body is disposed in the region of the drive journal, which inflow body is located at least partially outside the hull as a function of the pivot angle.

Due to the inflow body, which functions as a spoiler, the hydrodynamic flow properties can be optimized in the region of the drive journal.

In the case of a further advantageous design, the flow-edge-side inflow body is oriented essentially parallel to the hull longitudinal axis.

Due to the lack of an angle of attack or an angle of attack of 0° or an only slight angle of attack of the inflow body, no significant resistance increase is given during pivoting of the stabilizing surface.

In one favorable refinement a cross-sectional geometry of the flow-edge-side inflow body essentially corresponds to a cross-sectional geometry of the stabilizing surface in the region of the leading edge in the vicinity of the hull.

Turbulence in a boundary zone between inflow body and stabilizing surface can thereby be minimized.

The hull of the watercraft preferably includes at least one receiving pocket for preferably complete receiving of each associated stabilizing surface.

Consequently when the stabilizing device is not in use, in the ideal case the at least one stabilizing surface can be completely housed in the associated receiving pocket to minimize the flow resistance of the hull. The receiving pocket can have a larger volume than the volume required for complete receiving of the stabilizing surface.

In addition, the above-mentioned disclosure is achieved by a method including the following characterizing steps:

a) periodical pivoting of the at least one stabilizing surface about a pivot axis by a pivot angle, and b) the rotating of the stabilizing surface about an axis of rotation, which rotating is superposed on the pivoting of the at least one stabilizing surface, such that hydromechanical forces caused by the stabilizing surface moving under water cause an effective damping of the rolling movements of the watercraft.

Consequently an excellent stabilizing effect is possible compared to rolling movements of the watercraft with a simultaneously significantly reduced size of the stabilizing surface.

In one refinement of the method it is provided with an activated stabilizing device the pivot angle of the at least one stabilizing surface about the pivot axis falls between 30° and 150°.

With watercraft not moving through the water, or moving only slowly through the water, sufficiently high hydromechanical, in particular hydrodynamic, forces for damping the rolling of the watercraft can thereby be built up. Larger pivot angles of the stabilizing surface can lead to a collision with the hull and result in lower hydromechanical forces.

Preferably the stabilizing surface is rotated about the axis of rotation by an angle of attack of up to ±60°.

Consequently a suitable limiting of the flow resistance of the stabilizing surface moving under water is possible in the active state of the stabilizing device.

In the following a preferred exemplary embodiment of the invention is explained in more detail with reference to schematic Figures.

DETAILED DESCRIPTION

Figure 1:
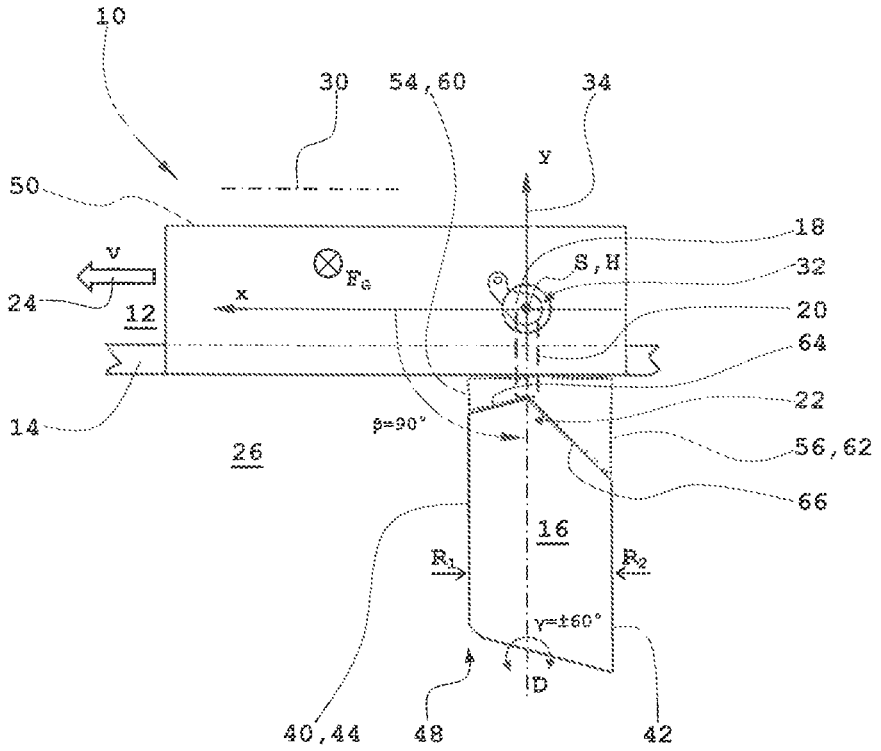
FIG. 1 is a schematic plan view of a pivotable stabilizing surface of a stabilizing device in a central position.

FIG. 1 shows a greatly schematized plan view of a pivotable stabilizing surface of a stabilizing device in a central position.

An active stabilizing device 10 of a ship 12 not shown in more detail including a hull 14 includes inter alia an approximately rectangular, fin-type stabilizing surface 16 that is, if necessary, simultaneously pivotable about a pivot axis S and rotatable about an axis of rotation D using a hydraulic positioning device 18 including a drive journal 20. Here the stabilizing surface 16 is connected in the region of its root 22 to the drive journal 20.

A preferred direction of travel of the ship 12 through the water 26 is indicated by the arrow 24. An optional speed v of the ship 12, which essentially does not move through the water 26 when the stabilizing device 10 is in operation, is small or even in the range of zero in comparison to normal travel or cruising speed of the ship, which in the context of this description is equivalent to a speed v of the ship of at most 6 km/h. The hull 14 of the ship 12 is in general configured mirror-symmetric with respect to a hull longitudinal axis 30, that is, in addition to the port-side stabilizing device 10 illustrated here the hull 14 of the ship 12 includes a further starboard-side stabilizing device configured mirror-symmetric to the stabilizing device 10 but not depicted in drawing. Here the term "starboard side" means rightward in the direction of travel of the ship 12, while "port side" defines leftward in the direction of travel of the ship 12. In the normal operating state of the ship 12 at least the stabilizing surface 16 of the stabilizing device 10 is always located completely under water 26.

A rectangular coordinate system 32 of the hull 14 includes an x-axis pointing in the direction of travel of the ship 12 and extending parallel to the hull longitudinal axis 30, and a y-axis or transverse axis 34 extending at right angles thereto. A vertical axis H extends through the intersection of the x-axis and of the y-axis of the rectangular coordinate system 32 and respectively perpendicular to the x-axis and y-axis. With no heeling of the hull 14 the vertical axis H (yaw axis) is aligned parallel to the force of gravity $F_G$. Here the pivot axis coincides merely by way of example with the height axis H of the coordinate system 32 so that the stabilizing surface 16 projects practically horizontally from the hull 14. Varying from this the pivot axis S can be disposed inclined in relation to the vertical axis H of the coordinate system 32 by an angle of more than 0°, and here up to 45° (cf. FIG. 1*a*). The pivot movements of the stabilizing surface 16 occur about the pivot axis S while the rotational movements superposed on the pivot movements, or the changes of an angle of attack γ of the stabilizing surface 16, occur about the axis of rotation D. The axis of rotation D of the stabilizing surface 16 coincides only in the central position depicted here with the y-axis of the coordinate system 32.

The axis of rotation D extends parallel with respect to a leading edge 40 and a trailing edge 42 of the stabilizing surface 16. Varying from this a non-parallel course of the axis of rotation D is also possible in relation to the leading edge 40 and/or the trailing edge 42 of the stabilizing surface 16, and technically advantageous in particular cases. To provide an inflow nose 44 having a suitable, fluidically optimal profiling a radius of curvature $R_1$ of the leading edge 40 is dimensioned significantly larger than a radius of curvature $R_2$ of the trailing edge 42.

Varying from the straight-line arrangement of the stabilizing surface 16 and drive journal 20 of the positioning device 18 shown here, the stabilizing surface 16 can also be connected to the drive journal 20 at a not-shown angle α of, for example, ±15° or more.

Using the positioning device 18 the stabilizing surface 16 can pivot into the central position 48 illustrated here, wherein the pivot angle β is approximately 90°, so that the stabilizing surface 16 projects practically at right angles from the hull 14 of the ship 12. Simultaneously the stabilizing surface 16 can be rotated about its axis of rotation D by an angle of attack γ in a range of approximately ±60°.

According to the disclosure, when the stabilizing device 10 is activated the stabilizing surface 16 is periodically pivoted with respect to the central position 48 depicted here and at a not-too-high speed by a (relative) pivot angle β in an angular range of up to ±60° about the pivot axis S, and simultaneously rotated about the axis of rotation D by the angle of attack γ in an angular range also of up to ±60° with respect to the horizontal in the form of the xy plane of the coordinate system 32 or a water line, not depicted in more detail, of the hull 14 of the ship 12. With respect to the rest position of the stabilizing surface 16 completely folded into the receiving pocket 50, the (absolute) angle β falls between 30° and 150° (cf. in particular FIG. 2). Here the controlling of the positioning device 18 is effected with the aid of a not-shown efficient control and/or regulating device taking into account measured values of a complex sensor system for detection of in particular roll, pitch, and yaw movements as well as the speed v of the ship 12 in the water 26 in real time. Consequently a particularly efficient and effective damping of undesirable rolling movements of the ship 12 about the hull longitudinal axis 30 is possible. In this process, hydromechanical forces caused by the stabilizing surface 16 are used wherein the rotational and pivot movements of the stabilizing surface 16 can occur in a temporally alternate manner, successively, or temporally adapted to each other for the application. Thus the stabilizing device 10 is in principle usable at a speed v of zero and at a speed v of the ship 12 greater than zero. Here the pivot movement of the stabilizing surface 16 about the pivot angle β and the rotational movement of the stabilizing surface 16 about the axis of rotation D are temporally superposed one-over-the-other in a suitable manner.

Figure 2:
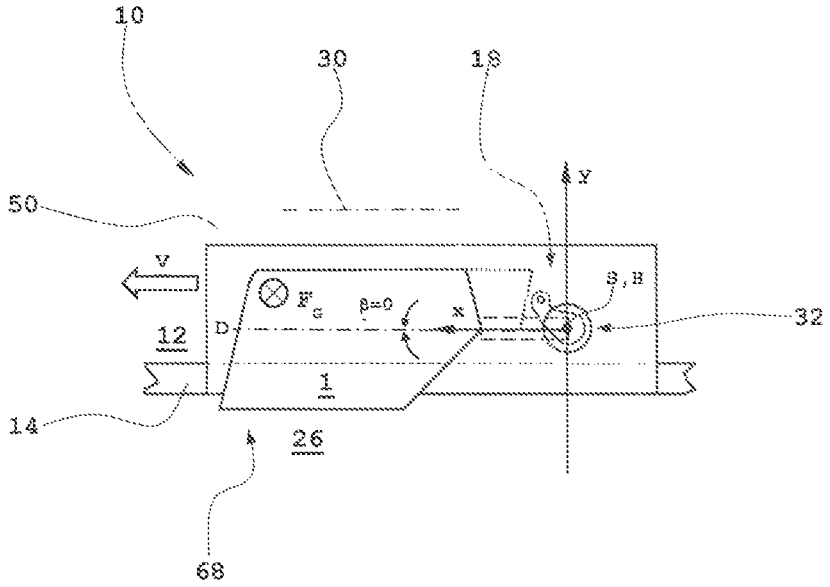
FIG. 2 is a plan view of the stabilizing surface in a rest position.

In the ideal case, to reduce the flow resistance of the hull 14 and avoid turbulence, the stabilizing surface 16 is completely receivable in the receiving pocket 50 of the hull 14, wherein a pivot angle β between the axis of rotation D and the hull longitudinal axis 30 is approximately 0° (cf. in particular FIG. 2).

Leading-edge-side in the region of the root 22, the stabilizing surface 16 furthermore includes a first rectangular cutout 54 and, trailing-edge-side, a second rectangular cutout 56. Due to the two cutouts 54, 56, inter alia a collision of the stabilizing surface 16 with the hull 14 of the ship 12 is avoided during pivoting of the stabilizing surface 16.

In addition, a flow-edge-side first inflow body 60 can be provided at least in the region of the first cutout 54 of the stabilizing surface 16, as indicated here in drawing by a dotted black line. Depending on the pivot angle β, the first inflow body 60 is respectively located at different distances from the hull 14 of the ship 12.

In addition, the inflow body 60 is oriented essentially parallel to the hull longitudinal axis 30, that is, the inflow body 60 essentially does not perform or does not completely perform the rotational movements, caused by the positioning device 18, about the axis of rotation D. To minimize undesirable turbulence, a cross-sectional geometry of the inflow body 60 furthermore preferably corresponds to the cross-sectional geometry of the leading edge 40 in the region of the root 22 of the stabilizing surface 16. The inflow body 60 serves primarily for optimizing the hydrodynamic properties of the stabilizing surface 16 in a further pivoted-out state.

In addition, an outflow-edge-side second inflow body 62 can also be provided at least regionally in the region of the second cutout 56 of the stabilizing surface 16.

In the ideal case, the first inflow body 60 abuts, in as gap-free a manner as possible, against a first hull-side narrow side 64 of the stabilizing surface 16, and the optional second inflow body 62 also in the ideal case abuts against a second hull-side narrow side 66 of the stabilizing surface 16 without intermediate space.

Figure 1A:
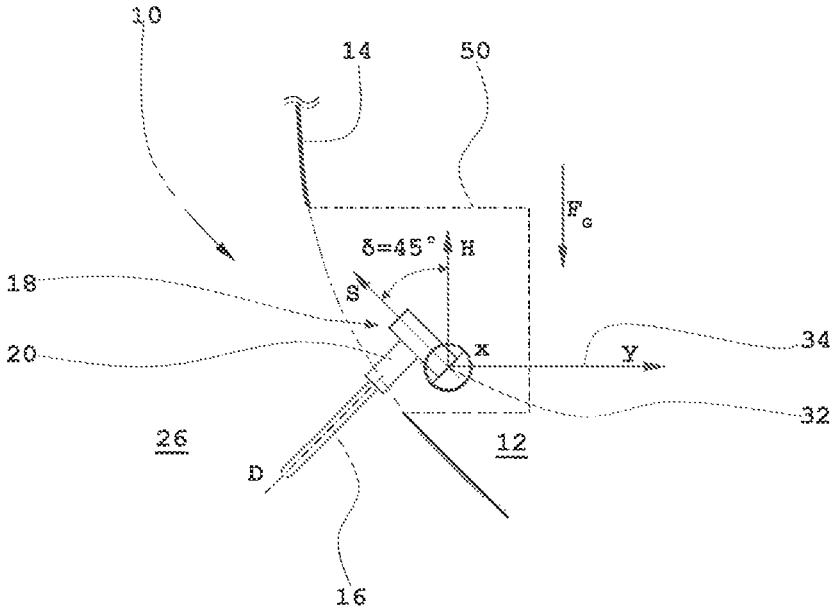
FIG. 1*a* is a simplified cross-sectional representation of the stabilizing surface having an inclined pivot axis.

FIG. 1*a* shows a simplified cross-sectional representation of the stabilizing surface having an inclined pivot axis.

The coordinate system 32 comprises the y-axis or the transverse axis 34, the x-axis extending parallel to the hull longitudinal axis, and the vertical axis H. With no heeling of the hull 14 of the ship 12, the vertical axis H extends approximately parallel to the force of gravity $F_G$. The stabilizing device 10 including the hydraulic positioning device 18 is disposed in the receiving pocket 50 of the hull 14 of the ship 12. The stabilizing surface 16 is attached to the drive journal 20 of the positioning device 18. Using the positioning device 18, the stabilizing surface 16 located under water 26 is simultaneously pivotable about the pivot axis S and rotatable about the axis of rotation D. In contrast to the representation of FIG. 1, here the pivot axis S is disposed merely by way of example inclined by an angle of inclination δ of 45° in relation to the vertical axis H.

FIG. 2 illustrates a plan view of the stabilizing surface in a rest position.

In a so-called rest position 68 shown here, the stabilizing surface 16 of the stabilizing device 10 is received almost completely into the receiving pocket 50 of the hull 14 of the ship 12 or pivoted thereinto by the positioning device 18. The pivot angle β of the stabilizing surface about the pivot axis S of the coordinate system 32 is thus approximately 0° so that the axis of rotation D of the stabilizing surface 16 and the x-axis of the coordinate system 32 coincide.

Figure 3:
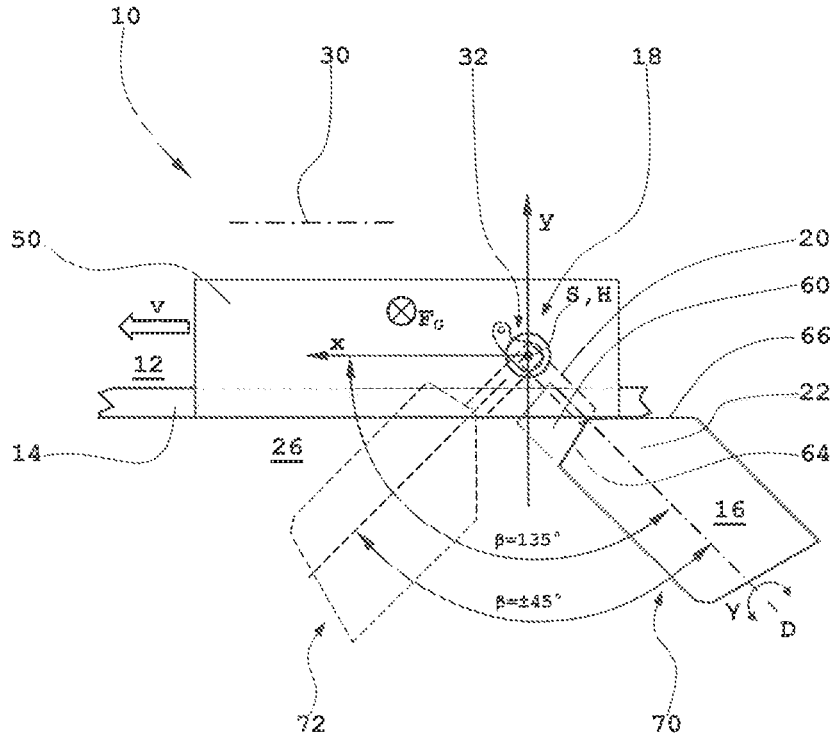
FIG. 3 is a plan view of the stabilizing surface in a rear position.

FIG. 3 shows a plan view of the stabilizing surface in a rear position.

In a so-called rear (stern-side) position 70 depicted graphically here, the stabilizing surface 16 of the stabilizing device 10 has assumed, by a corresponding method of the positioning device 18, a pivot angle β of approximately 135° with respect to the x-axis of the coordinate system 32 and the axis of rotation D. In this position the second hull-side narrow side 66 of the stabilizing surface 16 nearly contacts the hull 14 of the ship 12 so that a further pivoting of the stabilizing surface 16 is no longer indicated in this direction. Due to the first inflow body 60 indicated by a dotted black line, a direct inflow of the first hull-side narrow side 64 of the stabilizing surface 16 and parts of the drive journal 20 through the water 26 is avoided, and thus the flow resistance of the stabilizing device 10 is reduced.

When the stabilizing device 10 is activated for damping undesirable rolling movements of the hull 14 of the ship 12 about the hull longitudinal axis 30, the stabilizing surface 16 can periodically pivot back and forth, for example, periodically between the rear position 70 symbolized by a black solid line and a front (bow-side) position 72—illustrated with a dashed outline of the stabilizing surface 16—wherein to vary the angle of attack of the stabilizing surface 16 in the water 26, the stabilizing device 10 simultaneously performs superposed rotational movements about the axis of rotation D.

Viewed in isolation, the pivot movement, depicted here merely by way of example, of the stabilizing surface 16 of the stabilizing device 10 essentially corresponds to a pivot angle β of ±45° with respect to the y-axis of the coordinate system 32 (transverse axis) or the central position of the stabilizing surface 16 of FIG. 2.

In principle pivot angles β of up to ±60° with respect to the y-axis of the coordinate system 32 or the central position of the stabilizing surface 16 are possible using the positioning device 18.

Figure 4:
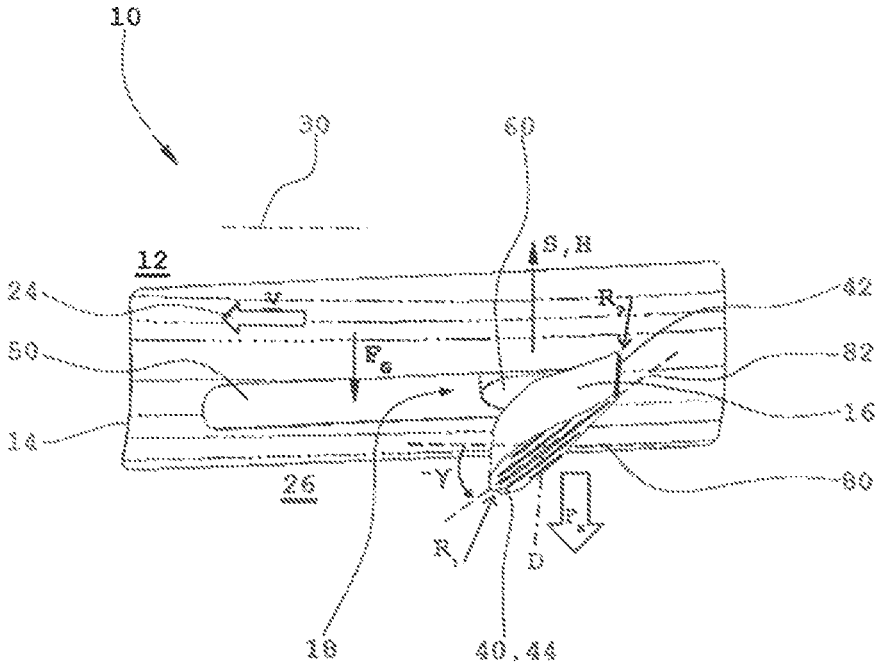
FIG. 4 is a perspective view of the stabilizing surface in the central position according to FIG. 1 with a negative angle of attack.

FIG. 4 shows a perspective view of the stabilizing surface in the central position according to FIG. 1 with a negative angle of attack.

The hull 14 of the ship 12 including the hull longitudinal axis 30 again moves in turn at the speed v through the surrounding water 26. Using the positioning device 18, the stabilizing surface 16 of the stabilizing device 10 is pivoted out of the receiving pocket 50 of the hull 14 into the central position (cf. in particular FIG. 1) so that the pivot angle not shown here of the stabilizing surface 16 falls at approximately 90° about the pivot axis S.

For the design of the sectionally drop-shaped inflow nose 44, the radius $R_1$ of the leading edge 40 is dimensioned significantly larger than the radius $R_2$ of the trailing edge 42 of the stabilizing surface 16. The axis of rotation D extends approximately parallel between the leading edge 40 and the trailing edge. A horizontal 80 or a horizontal plane extends parallel to the hull longitudinal axis 30 of the hull 14 of the ship 12 or approximately parallel to the not-depicted water line of the ship 12 or of the water surface, or the xy plane of the coordinate system 32 of FIGS. 1 to 3. The axis of rotation D again extends parallel to the leading edge 40 and the trailing edge 42 of the stabilizing surface 16 and defines a central plane 82 of the stabilizing surface 16.

In the illustrated position of the stabilizing surface 16 it is rotated about the axis of rotation D by a negative angle of attack −γ or in the counterclockwise direction, so that inter alia a hydromechanical force $F_H$ acts on the stabilizing surface 16, which is oriented essentially opposite to the pivot axis S or in the direction of the force of gravity $F_G$. The hydromechanical force $F_H$ generates a corresponding torque about the hull longitudinal axis 30 for the greatest possible compensation of rolling movements of the hull 14 of the ship 12 with the aid of the stabilizing surface 16. The angle of attack −γ consists in the result between the central planes 82 of the stabilizing surface 16 and the horizontal 80.

The inflow body 60 is located almost completely inside the receiving pocket 50 and is oriented essentially parallel to the hull longitudinal axis 30, that is, the inflow body 60 essentially does not carry out the rotational movement of the stabilizing surface 16 about the axis of rotation D up to reaching the angle of attack −γ.

Figure 5:
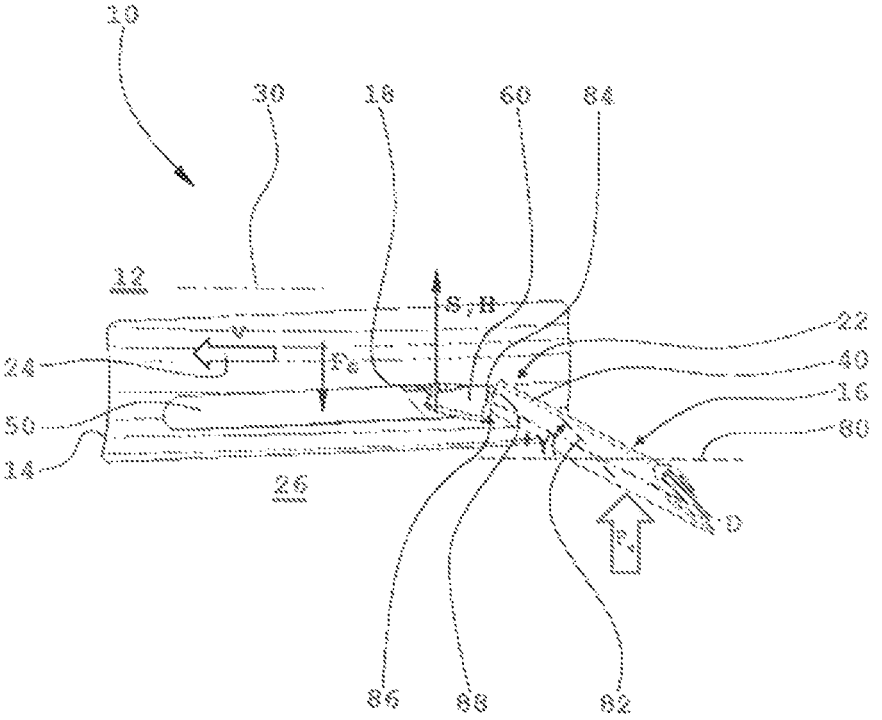
FIG. 5 is a perspective view of the stabilizing surface in the rear position of FIG. 3 with a positive angle of attack.

FIG. 5 illustrates a perspective view of the stabilizing surface in the rear position of FIG. 3 with a positive angle of attack.

The ship 12 including the stabilizing device 10 integrated in the hull 14 again moves in turn at the speed v in the direction of the arrow 24 through the surrounding water 26. The stabilizing surface 16 is pivoted by the pivot angle S about the pivot angle also not shown here so far that it has assumed the maximum possible rear position of FIG. 3 without a direct mechanical contact with the hull 14.

A cross-sectional geometry 84 of the first inflow body 60 corresponds, at least in a transition zone 86 with respect to the stabilizing surface 16, with a cross-sectional geometry 88 of the stabilizing surface 16 in this region. Consequently the flow resistance of the stabilizing surface 16 in the water 26 can be significantly reduced at least with an angle of attack γ of the stabilizing surface 16 in the vicinity of 0°, that is, with essentially horizontally aligned stabilizing surface 16.

Here the inflow body 60 is pivoted almost completely out of from the receiving pocket 50 of the hull 14, wherein the inflow body 60 is oriented unchanged with respect to the hull longitudinal axis 30.

In contrast to the representation of FIG. 4, here the stabilizing surface 16 is rotated by a positive angle of attack of +γ about the axis of rotation D or in the clockwise direction, that is, the angle of attack is +γ between the central plane 82 of the stabilizing surface 16 and the horizontal 80. Due to the now positive angle of attack +γ, inter alia a hydromechanical force $F_H$ directed in the direction of the pivot axis S or against the force of gravity $F_G$ acts on the stabilizing surface 16. The hydromechanical force $F_H$ leads to a corresponding (tilting) torque about the hull longitudinal axis 30 of the ship 12, which serves for the most extensive possible compensation of the undesirable rolling movements of the hull 14 of the ship 12 about the hull longitudinal axis 30.

Using the positioning device 18, the angle of attack γ of the stabilizing surface 16, and simultaneously superposed pivot angle about the pivot axis S in a range of up to ±60° are representable.

In the further course of the description the method for operating the stabilizing device 10 shall be explained by way of example with reference to FIGS. 1 to 5, wherein it is assumed that the speed v of the ship 12 through the water 26 is essentially equal to zero or has a small value of up to 6 km/h.

According to the method, the at least one stabilizing surface 16 is, for example, periodically pivoted by the pivot angle β from the central position 48 according to FIG. 1, about the pivot axis S extending essentially parallel to the force of gravity $F_G$ or of the weight force when there is no heeling of the hull 14 of the ship 12. This pivot movement is superposed by a rotational movement of the stabilizing surface 16 about the axis of rotation D extending parallel to the leading edge 40 and/or the trailing edge 42 of the stabilizing surface 16 by the angle of attack γ of up to ±60°, such that hydrodynamic forces $F_H$ caused by the stabilizing surface 16 always moving under water 26 cause an effective damping of the rolling movements of the watercraft.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved active stabilizing devices and methods.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMBER LIST

10 Stabilizing device
12 Ship
14 Hull
16 Stabilizing surface
18 Positioning device
20 Drive journal
22 Root
24 Arrow
26 Water
30 Hull longitudinal axis
32 Coordinate system
34 Transverse axis
40 Inflow edge
42 Outflow edge
44 Inflow nose
48 Central position
50 Receiving pocket (hull)
54 First cutout
56 Second cutout
60 First inflow body
62 Second inflow body
64 First hull-side narrow side
66 Second hull-side narrow side
68 Rest position
70 Rear position (stabilizing surface)
72 Front position (stabilizing surface)
80 Horizontal
82 Central plane (stabilizing surface)
84 Cross-sectional geometry (first inflow body)
86 Transition zone
88 Cross-sectional geometry (stabilizing surface)
β Relative, absolute pivot angle (stabilizing surface)
γ Angle of attack (stabilizing surface)
δ Angle of attack (pivot axis)
$F_G$ Gravitational force
$F_H$ Hydromechanical force
H Vertical axis
D Axis of rotation
S Pivot axis
v S peed
$R_1$ Radius of curvature of the leading edge (stabilizing surface)
$R_2$ Radius of curvature of the trailing edge (stabilizing surface)

What is claimed is:

1. An active stabilizing device for a primary damping of rolling movements of a ship or other watercraft, comprising:

at least one positioning device including a drive journal and a stabilizing fin having a stabilizing surface and a root, the drive journal being attached to the stabilizing fin at the root, the stabilizing surface having a leading edge and a trailing edge and being configured to be disposed underwater, wherein the positioning device is configured to simultaneously pivot the stabilizing fin about a pivot axis by a pivot angle and rotate the stabilizing fin about an axis of rotation of the drive journal, and wherein an inflow-edge-side in a region of a root of the stabilizing fin includes an inflow-edge side cutout, and/or an outflow-edge-side in the region of the root of the stabilizing fin includes an outflow-edge-side cutout.

2. The active stabilizing device according to claim 1, wherein the stabilizing fin is rotatable by an angle of up to ±60° about the axis of rotation.

3. The active stabilizing device according to claim 1, wherein a radius of curvature of the leading edge of the stabilizing surface is greater than a radius of curvature of the trailing edge.

4. The active stabilizing device according to claim 1, wherein a non-co-rotating flow-edge-side inflow body is disposed in the region of the drive journal and configured to be located at least partially outside a hull.

5. The active stabilizing device according to claim 1, wherein the non-co-rotating flow-edge-side inflow body is substantially parallel to the hull longitudinal axis.

6. An active stabilizing device for a primary damping of rolling movements of a ship or other watercraft, comprising:

at least one positioning device including a drive journal and a stabilizing fin having a stabilizing surface and a root, the drive journal being attached to the stabilizing fin at the root, the stabilizing surface having a leading edge and a trailing edge and being configured to be disposed underwater, wherein the positioning device is configured to simultaneously pivot the stabilizing fin about a pivot axis by a pivot angle and rotate the stabilizing fin about an axis of rotation of the drive journal, wherein a non-co-rotating flow-edge-side inflow body is disposed in the region of the drive journal, which non-co-rotating flow-edge-side inflow body is configured to be located at least partially outside a hull, and wherein a cross-sectional geometry of the non-co-rotating flow-edge-side inflow body substantially corresponds to a cross-sectional geometry of the stabilizing fin in a region of the leading edge.

7. The active stabilizing device according to claim 1, wherein the drive journal is configured to pivot the stabilizing fin such that the leading edge is substantially parallel to a longitudinal axis of the watercraft.

8. A method for damping rolling movements of a ship or other watercraft including a hull having a longitudinal axis, the method comprising;

providing at least one positioning device including a drive journal extending from the hull and a stabilizing fin having a stabilizing surface and a root, the drive journal being attached to the stabilizing fin at the root, the stabilizing surface having a leading edge and a trailing edge and being configured to be disposed underwater, and periodically pivoting the at least one stabilizing fin about a pivot axis while simultaneously rotating the stabilizing surface about an axis of rotation of the drive journal.

9. The method according to claim 8, wherein pivoting the at least one stabilizing fin comprises pivoting the at least one stabilizing fin between an angle of 30° and 150° relative to the hull longitudinal axis.

10. The method according to claim 9, wherein rotating the at least one stabilizing fin comprises rotating the at least one stabilizing fin about the axis of rotation by up to ±60°.

11. The active stabilizing device according to claim 1, wherein the stabilizing fin includes a proximal end and a distal end, the proximal end being located between the distal end and the pivot axis, and wherein the inflow-edge-side cutout comprises an inflow-edge-side portion of the proximal end that is not perpendicular to the axis of rotation.

12. The active stabilizing device according to claim 11, wherein the outflow-edge-side in the region of the root includes the outflow-edge-side cutout, and wherein the outflow-edge-side cutout comprises an outflow-edge-side portion of the proximal end that is not perpendicular to the axis of rotation.

13. The method according to claim 8, wherein periodically pivoting the at least one stabilizing fin about a pivot axis while simultaneously rotating the stabilizing surface about an axis of rotation of the drive journal comprises periodically pivoting the at least one stabilizing fin back and forth about a pivot axis while simultaneously periodically rotating the stabilizing surface back and forth about an axis of rotation of the drive journal.

* * * * *